US008076623B2

(12) United States Patent
Dryer

(10) Patent No.: US 8,076,623 B2
(45) Date of Patent: Dec. 13, 2011

(54) PROJECTILE CONTROL DEVICE

(75) Inventor: Richard L. Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 214 days.

(21) Appl. No.: 12/405,310

(22) Filed: Mar. 17, 2009

(65) Prior Publication Data

US 2010/0237185 A1 Sep. 23, 2010

(51) Int. Cl.

| | |
|---|---|
| ***F42B 10/48*** | (2006.01) |
| ***F42B 15/01*** | (2006.01) |
| *F42B 10/00* | (2006.01) |
| *F42B 15/00* | (2006.01) |

(52) U.S. Cl. ..... 244/3.23; 244/3.1; 244/3.15; 244/3.21; 244/110 R; 244/113; 102/382; 102/384; 102/501

(58) Field of Classification Search ..... 244/3.1–3.3, 244/110 R, 113, 110 D; 89/1.11; 102/374–384, 102/473, 480, 501, 517, 519

See application file for complete search history.

(56) References Cited

U.S. PATENT DOCUMENTS

| | | | | | |
|---|---|---|---|---|---|
| 3,977,629 | A | * | 8/1976 | Tubeuf | 244/3.22 |
| 3,995,558 | A | * | 12/1976 | Travor et al. | 102/519 |
| 4,009,661 | A | * | 3/1977 | Dodd | 244/3.27 |
| 4,017,040 | A | * | 4/1977 | Dillinger et al. | 244/3.22 |
| 4,196,668 | A | * | 4/1980 | Morlock et al. | 89/1.11 |
| 4,211,378 | A | * | 7/1980 | Crepin | 244/3.22 |
| 4,428,293 | A | * | 1/1984 | Botwin et al. | 102/381 |
| 4,463,921 | A | * | 8/1984 | Metz | 244/3.22 |
| 4,573,648 | A | * | 3/1986 | Morenus et al. | 244/3.22 |
| 5,004,184 | A | * | 4/1991 | Bernard | 244/3.22 |
| 5,062,590 | A | * | 11/1991 | DiPrima et al. | 244/3.16 |
| 5,062,593 | A | * | 11/1991 | Goddard et al. | 244/3.22 |
| 5,158,246 | A | * | 10/1992 | Anderson, Jr. | 244/3.22 |
| 5,452,864 | A | | 9/1995 | Alford et al. | |
| 5,456,425 | A | * | 10/1995 | Morris et al. | 244/3.22 |
| 5,456,429 | A | * | 10/1995 | Mayersak | 244/3.22 |
| 6,502,786 | B2 | | 1/2003 | Rupert et al. | |
| 6,666,402 | B2 | | 12/2003 | Rupert et al. | |
| 7,163,176 | B1 | | 1/2007 | Geswender et al. | |
| 2004/0041059 | A1 | | 3/2004 | Kennedy et al. | |
| 2005/0151000 | A1 | | 7/2005 | Dodu et al. | |
| 2006/0065775 | A1 | | 3/2006 | Smith et al. | |
| 2006/0169833 | A1 | | 8/2006 | Lamorlette | |
| 2008/0061188 | A1 | | 3/2008 | Morris et al. | |

OTHER PUBLICATIONS

Definition of the word "rotor" in "Webster's Third New International Dictionary, Unabridged," Literature Online Reference Edition from ProQuest LLC; copyright in the year 1993.*

* cited by examiner

*Primary Examiner* — Bernarr Gregory

(74) *Attorney, Agent, or Firm* — Renner, Otto, Boisselle, & Sklar, LLP

(57) ABSTRACT

A spin-stabilized projectile is steered by taking air from an air intake at the front of the projectile, and expelling the air along an outer surface of the projectile to alter its trajectory toward the desired impact location. Air taken in through the air intake is directed toward a rotor that is able to rotate relative to the rest of the projectile. The rotor has an outlet that may direct the air taken in at the air inlet out in a direction having both radial and circumferential components. The force produced in the radial direction provides a steering force substantially normal to the projectile axis, used to steer the projectile. The force produced in the circumferential direction is used to provide impetus to spin the rotor. A brake is used to control the rotational speed of the rotor, to control the direction that the air is expelled from the projectile.

17 Claims, 6 Drawing Sheets

PROJECTILE CONTROL DEVICE

BACKGROUND OF THE INVENTION

1. Field of the Invention

The invention is in the field of spin-stabilized projectiles, and methods of controlling the flight of such projectiles.

2. Description of the Related Art

Efforts to provide guidance for spin-stabilized projectiles have focused on use of external aerodynamic control surfaces, such as canards, vanes, or lattice fins. There is room for improvement in guidance systems for spin-stabilized projectiles.

SUMMARY OF THE INVENTION

A fuzewell guidance kit or module for spin-stabilized projectiles, such as artillery shells, includes a rotor that rotates relative to the rest of the projectile, and that expels ram air in a selected direction, in order to steer the projectile. The exhaust air creates two effects: first it creates a thrust to the projectile in a direction complimentary to the exhaust vector, and secondly the exhaust air affects the pressure distribution on the body of the projectile, which in turn modifies its attitude and trajectory. The rotor counter rotates relative to the rest of the projectile in a direction opposite to the spin direction of the projectile. The guidance system includes a rotor braking system, such as a set of electromagnetic coils, to provide a braking force to control rotation of the rotor, to position the rotor outlet in a desired direction to effect course correction of the projectile, and to maintain the rotor in the direction long enough to provide the desired course correction.

According to an aspect of the invention, a spin-stabilized projectile includes a rotor that counter rotates relative to the rest of the projectile. The rotor takes in air along a longitudinal axis and expels the air in a different direction having radial and/or circumferential components.

According to another aspect of the invention, a spin-stabilized projectile includes a rotor that may be positioned to expel air in selected direction, to steer the projectile.

According to yet another aspect of the invention, a module for a spin-stabilized projectile includes: a module body; a rotor mechanically coupled to the module body, wherein the rotor has an air inlet and an air outlet in fluid communication with each other, with the outlet expelling air in a different direction from that in which air is received at the air inlet; and a control system for controlling rotation and positioning of the rotor.

According to a further aspect of the invention, a method of controlling flight of a projectile includes the steps of: spinning the projectile to stabilize flight of the projectile; taking air into the projectile at an air inlet along a longitudinal axis of the projectile; and selectively expelling the air from a perimeter of the projectile to modify the trajectory of the projectile.

According to a still further aspect of the invention, a spin-stabilized projectile has a rotor that expels air to steer the projectile (to provide course correction to the projectile), and a braking system to control positioning of the projectile. The braking system may include electromagnetic coils that produce a drag on the rotor by means of a magnetic field eddy current brake.

To the accomplishment of the foregoing and related ends, the invention comprises the features hereinafter fully described and particularly pointed out in the claims. The following description and the annexed drawings set forth in detail certain illustrative embodiments of the invention.

These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, illustrate aspects of the invention.

DETAILED DESCRIPTION

A spin-stabilized projectile is steered by taking air from an air intake at the front of the projectile, and expelling the air along an outer surface (perimeter) of the projectile to alter its trajectory toward the desired impact location. The air intake may be through a central inlet channel in a nose cap. Air taken in through the air intake is directed toward a rotor that is able to rotate relative to the rest of the projectile. The rotor has an outlet that may direct the air taken in at the air inlet out in a direction having both radial and circumferential components. The air expelled from the rotor may exit the projectile through exhaust vents in the nose cap. The force produced in the radial direction provides a steering force substantially normal to the projectile axis, used to steer the projectile, as well as modifying the pressure distribution on the projectile body. Both force and pressure distribution effect a change in the projectile attitude and hence its trajectory. The force produced in the circumferential direction is used to provide impetus to spin the rotor, counter rotating the rotor in an opposite direction from the spin direction of the projectile. A brake is used to control the rotational speed of the rotor, to control the direction that the air is expelled from the projectile, such as by selectively controlling which of the exhaust vents the expelled air exits through. The brake may include a series of electro-magnetic coils that create an electromagnetic field when power is applied to them, creating an eddy current drag in the rotor as the rotor spins or rotates through the magnetic field.

Figure 1A:
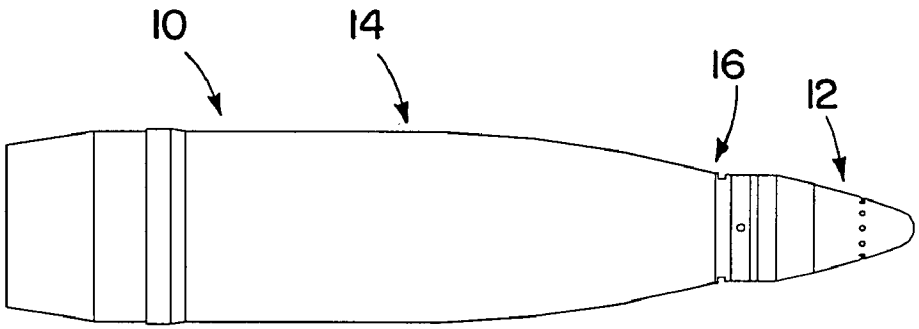
FIG. 1A is a side view of a spin-stabilized projectile using a guidance fuze module in accordance with an embodiment of the present invention.

Referring to FIG. 1A, a spin-stabilized projectile 10, such as an artillery shell, has a guidance fuze module 12 that fits into a threaded opening or hole (a fuzewell) 14 at the front of a body 16 of the projectile 10. The body 16 includes a payload such as an explosive warhead or other payloads such as: submunitions and dispenser; leaflets; and/or smoke or agent dispensers.

The projectile 10 is spin-stabilized in that a spin that is applied during firing, as the projectile interacts with the rifling in the cannon. This spin continues throughout the flight of the projectile 10, being slowly retarded by inertial and drag forces. The spin rate of the projectile 10 may be 200-300 Hz or more, depending upon the caliber of the projectile, its muzzle velocity and the cannon that fires it, for example, at firing or launch of the projectile 10.

Figure 1B:
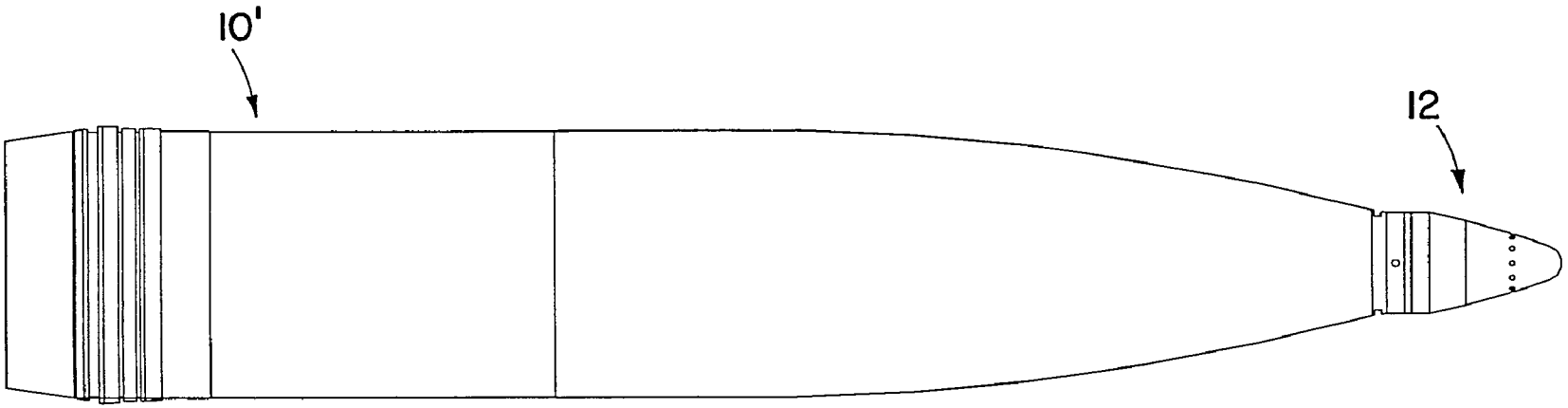
FIG. 1B is a side view of another spin-stabilized projectile using the guidance fuze module of FIG. 1A.
Figure 4:
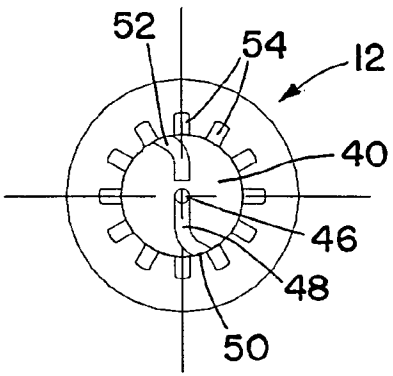
FIG. 4 is a cross-sectional view along line 4-4 of FIG. 2.
Figure 5:
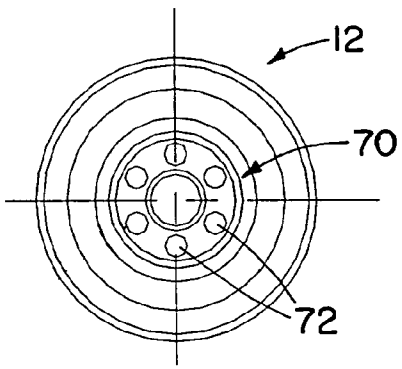
FIG. 5 is a cross-sectional view along line 5-5 of FIG. 2.
Figure 2:
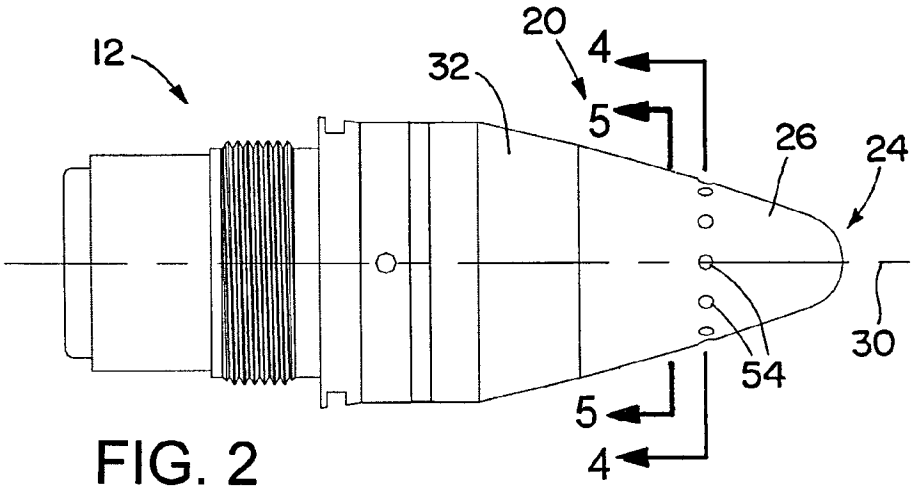
FIG. 2 is a side view of the module of FIG. 1A.

The projectile 10 is only one size of projectile that may receive the module 12. FIG. 1B shows a projectile 10' of another size (a different caliber) that also uses the module 12. The projectiles 10 and 10' are 105 mm and 155 mm artillery shells, but it will be appreciated that the nose module 12 may be usable with other different types of projectiles.

FIGS. 2-5 provide further details of the workings of the module 12. The module 12 includes a guidance system 20 that takes in air as during flight of the projectile 10, and expels the air in one or more selected directions. The projectile 10 is steered or guided by selecting the direction or directions in which the air is expelled from the projectile 10.

Air enters the module 12 at an air inlet 22 at the forward-most tip of a nose 24 of the module 12. The air inlet 22 may be a central opening in a nose cap 26 of the module 12. The air inlet 22 may be along a central longitudinal axis 30 of the module 12. The nose cap 26 is attached to a module body 32, at a threaded connection 34 at a back or aft end of the nose cap 26. The threaded connection 34 may include a threaded inner surface of the nose cap 26 that engages external threads of the module body 32.

Air entering through the air inlet 22 passes into a rotor 40. The rotor 40 is located in a well 42 between parts of the nose cap 26 and the module body 32. The rotor 40 rotates relative to the nose cap 26 and the module body 32. The rotation speed of the rotor 40 is controlled to control a direction or directions in which the air is expelled.

Air enters the rotor 40 through a central inlet passage 46. The inlet passage 46 runs along an axis of the rotor, which is aligned with the longitudinal axis 30 of the module 12. Inside the rotor 40, such as at a midplane of the rotor 40, the flow shifts from the longitudinal direction of the inlet passage 46 a radial direction, in a channel 48. As the channel 48 nears the perimeter of the rotor 40, the channel 48 curves to an outlet passage 50 that expels the air from the rotor 40 in a direction having both radial and circumferential components. The rotor 40 also has a dummy channel or balancing hole 52 diametrically opposed to the channel 48. The dummy channel 52 has a shape substantially similar to that of the channel 48. The dummy channel 52 does not have flow through it (it is not in fluid communication with the inlet passage 46). Its purpose to balance the rotor 40.

Air expelled from the rotor outlet 50 passes out of the module 12 through a series of air exhaust vents 54 in the nose cap 26. The exhaust vents 54 are a series of holes in the nose cap 26 at a longitudinal location corresponding to the location of the outlet passage 50 of the rotor 40. The exhaust vents 54 may be evenly spaced about the circumference of the nose cap 26 at the desired longitudinal location. In the illustrated embodiment there are twelve round holes that constitute the exhaust vents 54, although it will be appreciated that a different number of vents, and/or a different configuration for the vents, may be utilized.

The air thus changes direction as it passes through the module 12. It passes from a longitudinal (axial) direction at its entry through the air inlet 22 and the inlet passage 46, to an expelled direction, through the rotor outlet 50 and the exhaust vents 54, that has both radial and circumferential components. This change of direction produces forces on both the rotor 40 and on the projectile 10 (FIG. 1A) as a whole. Expelling air from the rotor 40 in a circumferential direction provides an impetus to the rotor 40 to cause the rotor 40 to rotate faster within the well 42 relative to the nose cap 26 and the module body 32. The radial component of the expelled air provides a radial force to the rotor 40. This radial force is in a direction substantially perpendicular to the projectile longitudinal axis 30 (which is the same as the axis of the rotor 40). Further it will be appreciated that a certain longitudinal force, tending to slow down the speed of the projectile 10, occurs as the result of the longitudinal change of velocity of the air received through the air inlet 22. However it will be appreciated that this constitutes only a drag minor force on the projectile 10. Exhaust air will also alter the pressure distribution along the exterior of the projectile body. This pressure will also affect the projectile body orientation, which in turn will alter its trajectory.

The radial force is transmitted from the rotor 40 to the module 12, and thus to the projectile 10 as a whole. The radial force is transmitted through sets of bearings 60 and 62 which surround an engage opposite ends of a central rotor shaft 64. The bearings 60 and 62 allow the rotor 40 to rotate freely in the well 42 relative to the nose cap 26 and the module body 32. The bearings 60 and 62 may be ball bearings, rotor bearings, or other types of well-known suitable bearings.

Figure 6:
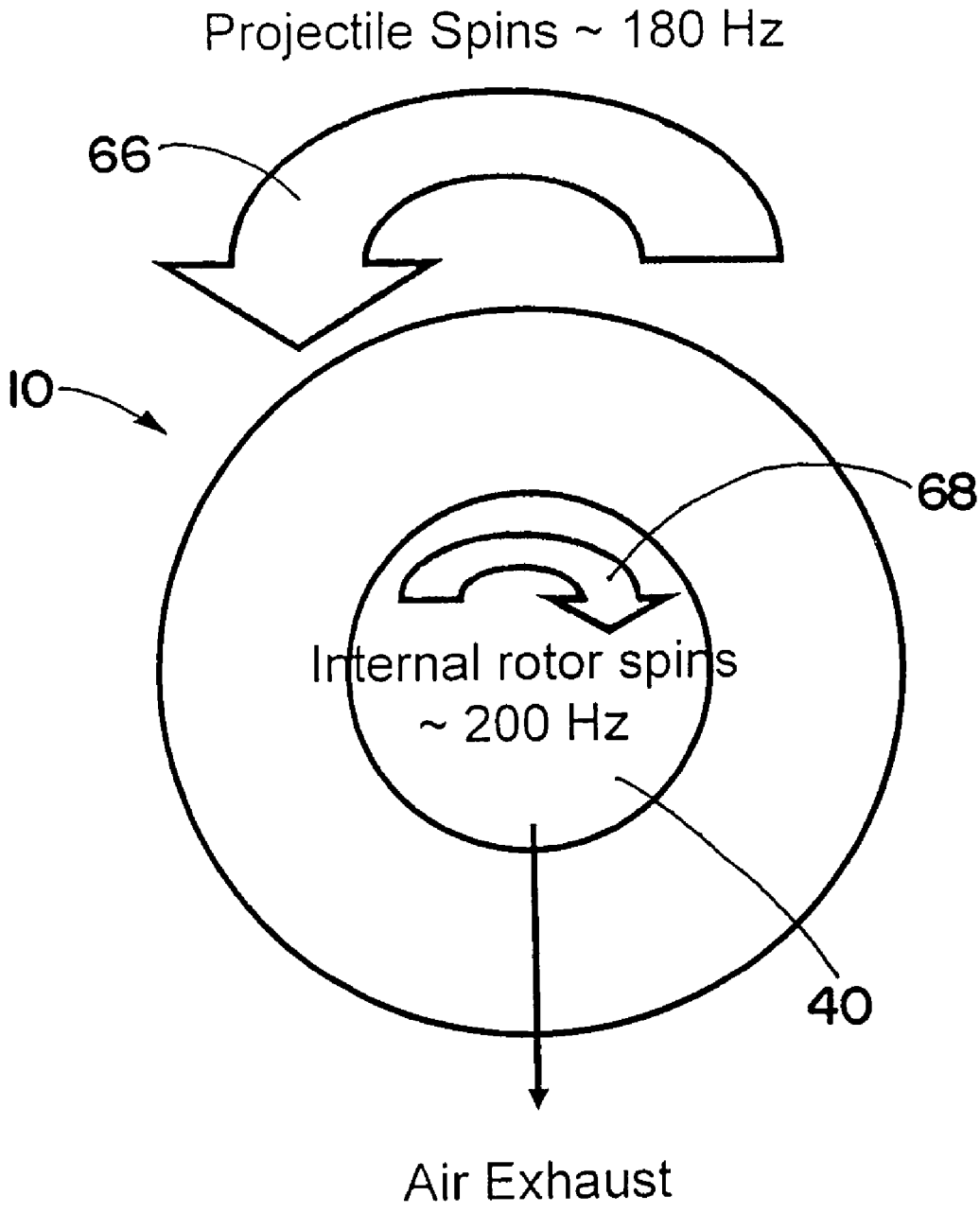
FIG. 6 is an end view of the projectile of FIG. 1A, illustrating spin of the projectile and counter rotation of a rotor of the guidance fuze module.

The rotor channel 48 and outlet 50 may be configured such that the circumferential force on the rotor 40 encourages the rotor 40 to rotate in the opposite direction from the spin of the projectile 10 (FIG. 1A). The circumferential force may encourage the rotor 40 counter rotate (rotate relative to the module body 32 in a direction opposite that of the spin of the projectile 10) at a rate faster than the spin rate of the projectile 10. That is, from a fixed frame of reference outside the projectile 10, the rotor 40 may spin in a direction opposite from the spin direction of the projectile 10. For example, with reference in addition to FIG. 6, if the projectile 10 has a counterclockwise spin direction 66 at 180 Hz, the circumferential force provided by expelling air through the rotor outlet 50 may provide sufficient circumferential force to the rotor 40 to cause the rotor 40 to rotate in a clockwise direction 68 at a rate of about 200 Hz relative to other parts of the projectile 10, or about 20 Hz relative to a fixed frame of reference outside of the projectile 10.

A braking system 70 may be used to selectively slow down the counter rotation of the rotor 40. This may be done to provide a selected orientation of the rotor 40 that may be maintained, relative to a fixed frame of reference outside of the projectile 10, even as the projectile 10 spins during its spin-stabilized flight. The brake 70 includes a series of electomagnetic coils 72 evenly spaced about the axis 30 at a given distance from the axis 30. The electromagnetic coils 72 are at one end of the module body 32, adjacent the well 42. When power is provided to the electromagnetic coils 72, a magnetic field is generated. As the rotor 40 rotates through this magnetic field, the rotor 40 experiences a drag, due to eddy currents in the rotor 40. This produces a drag on the rotor 40, slowing the rotation of the rotor 40. Control of the rotation of the rotor 40 therefore may be accomplished by control of the current applied to the electro-magnetic coils 72.

Other parts of the module 12 include a guidance electronics unit (GEU) 80, a global positioning system (GPS) antenna 86, a GPS receiver 88, a battery 90, a detonator block 94, a fuze safe and arm device 96, and a booster 98. The booster 98 is part of the fuzing system and functions to transmit the explosive energy of the detonator into the main charge of the explosive warhead. The GEU 80 is part of the guidance system 20, and is used for controlling the rotor 40 to steer the projectile 10. The GPS receiver 88 and the GPS antenna 86 are used for determining position and velocity of the projectile 10, which is information used by the GEU 80. The detonator block 92, the safe and arm device 96, and the booster 98 are all parts of a fuze system 100 for detonating the explosive warhead in the projectile 10. The battery 90 is used to power the guidance system 20 and/or the fuze system 100.

Figure 3:
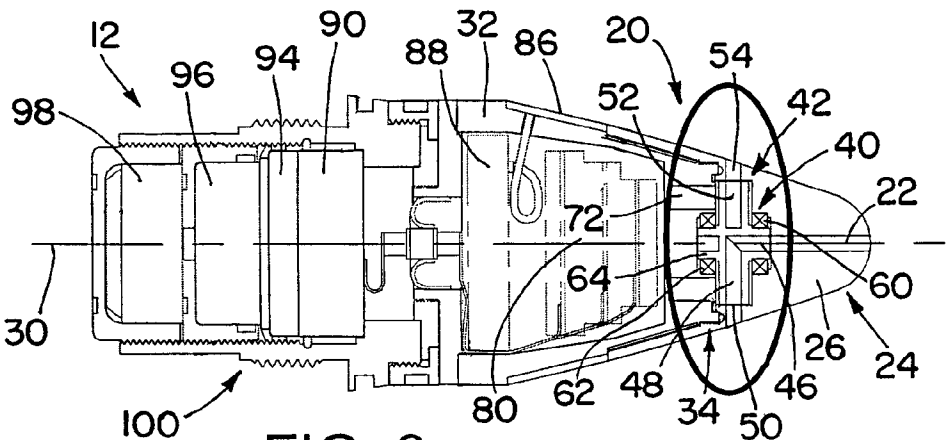
FIG. 3 is a side cross-sectional view of the module of FIG. 1A.
Figure 7:
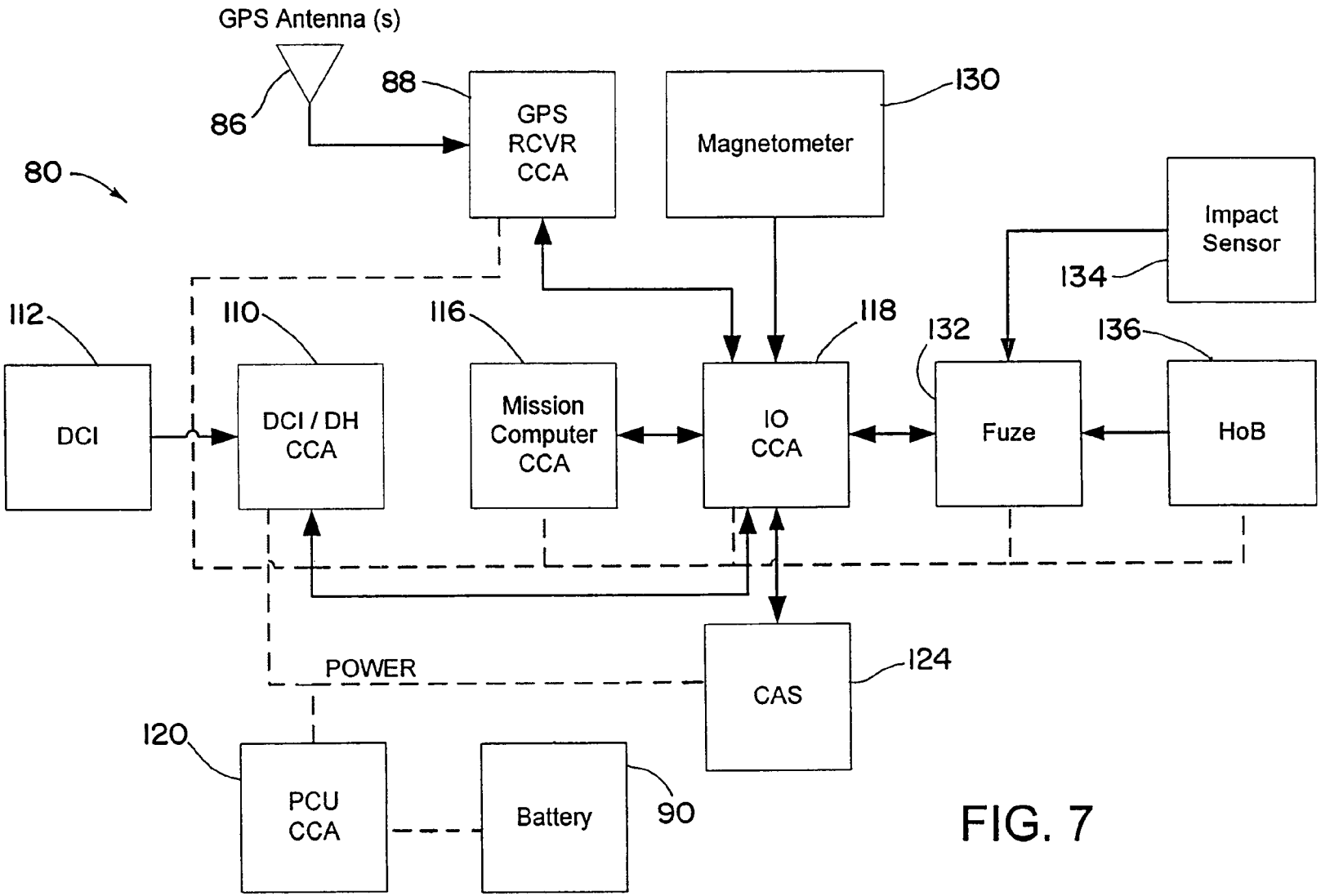
FIG. 7 is a block diagram of the guidance electronics unit of the module of FIG. 2.

FIG. 7 shows a block diagram of operative parts of the module 12. The GEU 80 includes various circuit card assemblies (CCAs) for performing various functions of the module 12. Among the CCAs are a data communications interface (DCI)/data hold (DH) CCA 110, which is coupled to a DCI coil 112; a mission computer CCA 116 that contains and processes information about target location, gun location, meteorological data, desired trajectory and fuzing mode selection as well as other information about the projectile mission; an input-output (IO) CCA 118, which controls the flow of information regarding course correction of the projectile 10 (FIG. 1A); and a power control unit (PCU) CCA 120, which is used to distribute power from the battery 90 to various components of the projectile 10. The GPS receiver 88 may also be in the form of a CCA, coupled to the GPS antenna 86. Power may be provided to a control actuator system (CAS) 124 to control rotation of the rotor 40 (FIG. 3).

Information regarding the position of the projectile 10 may be provided by a magnetometer 130. The magnetometer 130 provides a roll reference in order to determine the position (rotational orientation) of the projectile 10. It will be appreciated that this information (or the equivalent) is needed in order to accurately position the rotor 40, specifically the rotor outlet 50, in order to expel the air in the desired direction in order to provide an appropriate impulse or "nudge" to the projectile 10. The impulse or nudge to the projectile 10 may be used to correct the course of the projectile 10, or to otherwise change the flight direction of the projectile 10.

It will be appreciated that the magnetometer 130 is only one example of a roll reference. Alternatively the roller reference may be provided by another mechanism, such as a sun sensor.

The IO CCA 118 provides the required interfaces to the ancillary equipment that supports the guidance and control of the system. Guidance and control signals that are created within the mission computer CCA 116 are transmitted to the control actuation system thru the IO CCA 118. In a similar manner, fuzing enable signals, created in the mission computer CCA 116 are transmitted to a fuze 132 through the IO CCA 118. Mission data, such as, target location, gun location, meteorological data, desired trajectory, and/or fuzing mode selection are received thru the DCI 110, and are transmitted to the mission computer CCA 116 through the IO CCA 118. The purpose of the IO CCA 118 is to assure that the data being transmitted to each of these ancillary systems is formatted correctly and at the correct voltage level. The IO CCA 118 provides for a modularity in the system architecture and allows the system to easily adapt to requirements evolution by modifying subsystems while keeping the core elements intact.

The IO CCA 118 may also be linked to the fuze 132, as well as perhaps an impact sensor 134 and a height of burst (HoB) mechanism 136. This link may be used to provide proper timing for detonating the projectile 10.

When no braking force is applied to the rotor 40, the rotor 40 counter rotates at a faster rate than the spin of the rest of the projectile 10. This counter rotation causes air to be expelled from the rotor outlet 50 (and through the exhaust vents 54) in rapidly changing directions. This produces no net force on the projectile 10. Only when the brake 70 is activated does the rotor 40 slow down enough to expel air in a single direction relative to a fixed frame of reference. Only in this situation does the projectile 10 receive a net force from the guidance system 20.

Figure 9:
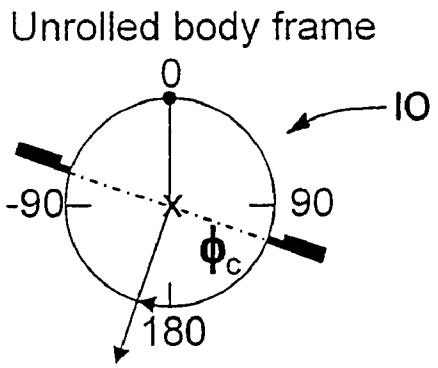
FIG. 9 is a diagram showing an angle of the rotor of the guidance system of FIG. 2, illustrating course correction using the system.
Figure 8:
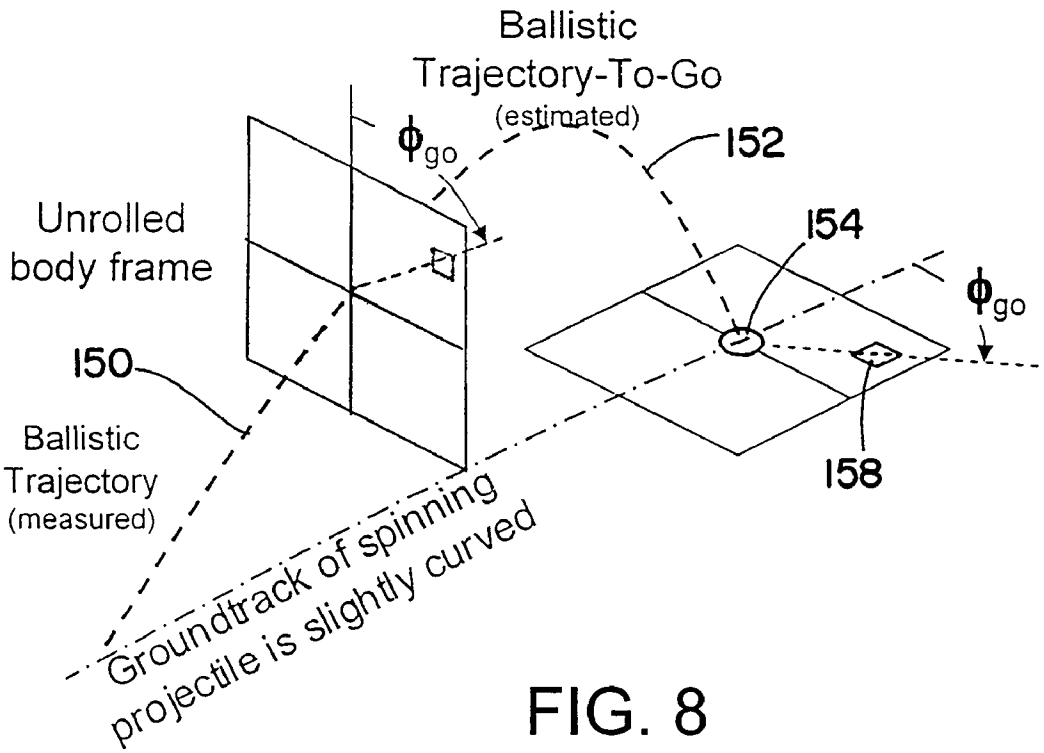
FIG. 8 is a diagram illustrating the course correction process using the module of FIG. 2.

With reference now to FIGS. 8 and 9, the correction performed by the guidance system 20 (FIG. 1A) is illustrated. The guidance system 20 uses the measured ballistic trajectory 150 of the flight so far, and estimates the ballistic trajectory 152 of the portion of the flight still to be accomplished. This produces an estimate of an angle correction $\phi_{go}$ needed to shift the trajectory 152 from its estimated (uncorrected) impact point 154, to a desired impact point 158, such as a target location. A look-up table or the like may be used to determine a rotor control direction $\phi_c$ as a function of the correction angle $\phi_{go}$. The look-up table or other correlation may be established by testing, analysis, and/or simulation. Gyroscopic moments and aero-Magnus forces may be taken into account in the determination of the rotor control direction $\phi_c$, since it will be appreciated that such moments and forces have an influence on the correction produced by setting the angle of the rotor 40 at a given direction.

The guidance system 20 advantageously provides for course correction without use of aerodynamic surfaces that protrude into an airstream. Such aerodynamic surfaces cause significant drag. The guidance system 20 provides a way of guiding the projectile 10 through a system located in the module 12 at the nose of the projectile 10. The guidance system 20 operates simply, and does not rely on use of any pressurized-gas-producing devices for propellants.

Other advantages of the guidance system 20 and the module 12 are low weight, low power requirements, and high reliability.

Figure 10:
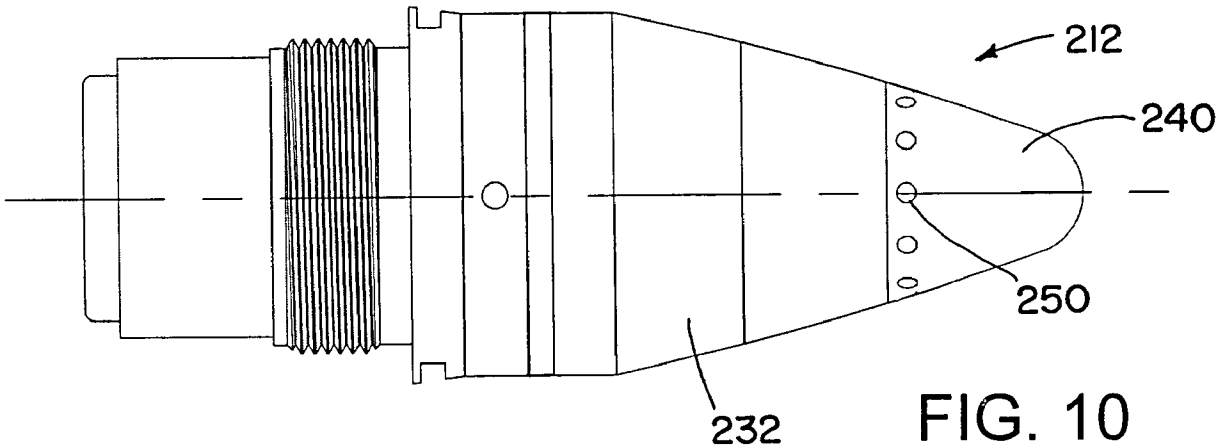
FIG. 10 is a side view of an alternate embodiment module in accordance with the present invention.
Figure 11:
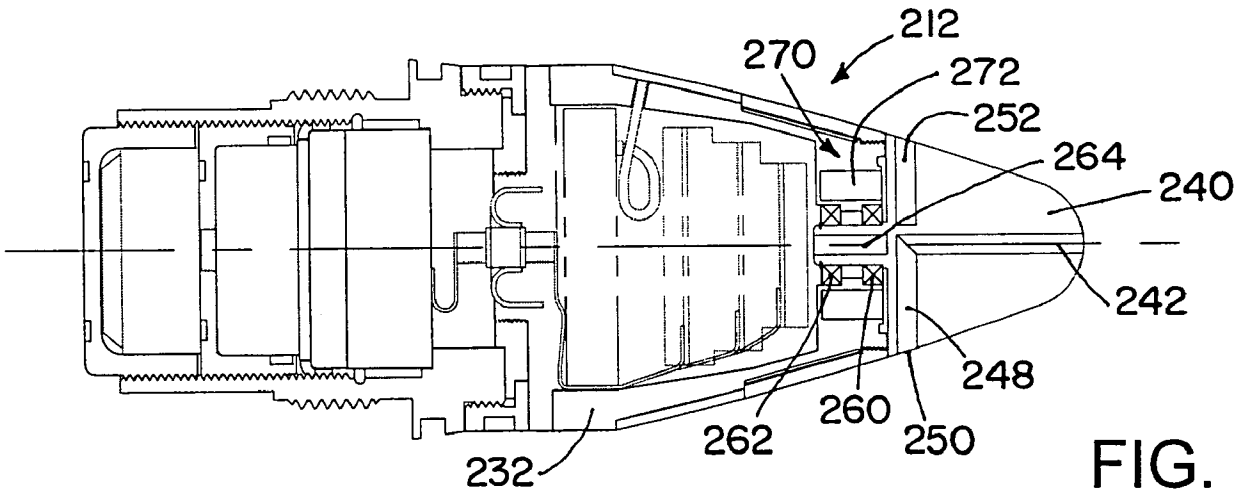
FIG. 11 is a side cross-sectional view of the module of FIG. 10.

FIGS. 10 and 11 show an alternate embodiment module 212. The module 212 has a rotor nose piece 240 located at the front tip of the module 212. The rotor 240 integrates the entire air flow passage in a single piece. The rotor 240 has an inlet 242 for receiving ram air along a longitudinal axis of the module 212, and an outlet 250 for expelling air from the module 212 in a direction having circumferential and radial components. A rotor channel 248 and a dummy channel or balancing hole 252 may be similar in configuration to the channels 48 and 52 of the module 12 (FIG. 3). A rotor shaft 264 at an aft end of the rotor 240 is coupled to a module body 232 at bearings 260 and 262. A braking system 270, with electromagnetic coils 272, may be used to control rotation rate and positioning of the rotor 240.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A module for a spin-stabilized projectile comprising:

a module body;

a rotor mechanically coupled to the module body, wherein the rotor has an inlet passage and an outlet passage in fluid communication with each other, with the outlet passage expelling air in a different direction from that in which air is received at the inlet passage; and a control system for controlling rotation and positioning of the rotor.

2. The module of claim 1, wherein the control system is a braking system for slowing counter rotation of the rotor.

3. The module of claim 2, wherein the braking system includes a electro-magnetic coils mounted in the module body; and wherein, when power is applied to the electro-magnetic coils, the rotor experiences a drag due to eddy currents from the electro-magnetic coils.

4. The module of claim 3, further comprising a guidance electronics unit operatively coupled to the electro-magnetic coils for selectively providing power to the electro-magnetic coils, to selectively brake the rotor.

5. The module of claim 1, wherein the air outlet has a radial component and a circumferential component, providing force, when air is expelled through the outlet, in both a radial direction to steer the projectile, and in a circumferential direction to rotate the rotor.

6. The module of claim 1, wherein the inlet passage of the rotor is substantially along a longitudinal axis of the module.

7. The module of claim 6, wherein the outlet passage of the rotor outlets air along a perimeter of the rotor.

8. The module of claim 1, wherein the rotor is in a well between the module body and a nose cap that is fixedly attached to the module body.

9. The module of claim 8, wherein the nosecap has a series of exhaust vents around a circumference of a longitudinal location of the nosecap, for allowing air expelled from the outlet to pass therethrough.

10. The module of claim 1, wherein the module is a fuze guidance module.

11. The module of claim 10, in combination a projectile body, wherein the fuze guidance module is threadedly coupled to an internally-threaded fuzewell of the projectile body.

12. A method of controlling flight of a projectile, the method comprising:

spinning the projectile to stabilize flight of the projectile;

taking air into the projectile at an air inlet along a longitudinal axis of the projectile;

selectively expelling the air from a perimeter of the projectile to modify the trajectory of the projectile; and further comprising changing direction of the air within a rotor of the projectile.

13. The method of claim 12, wherein the rotor counter rotates in an opposite direction from a spin direction of the projectile.

14. The method of claim 13, further comprising braking rotation of the rotor, selectively using a braking system of the projectile, to control the position of the rotor.

15. The method of claim 14, wherein the braking system includes electro-magnetic coils of the projectile; and wherein the braking includes applying power to the electro-magnetic coils to brake the rotor using eddy currents.

16. The method of claim 14, wherein, when no braking is applied using the braking system, the rotor counter rotates relative to a projectile body at a rate greater than a spin rate of the projectile.

17. The method of claim 12, wherein the rotor is part of a module located at a nose of the projectile.

* * * * *